US010413785B2

(12) United States Patent
Akiyama

(10) Patent No.: US 10,413,785 B2
(45) Date of Patent: Sep. 17, 2019

(54) GOLF CLUB HEAD OR OTHER BALL STRIKING DEVICE WITH REMOVABLE FACE AND/OR INTERNAL SUPPORT STRUCTURE

(71) Applicant: Nike, Inc., Beaverton, OR (US)

(72) Inventor: Hiromitsu Akiyama, Tokyo (JP)

(73) Assignee: Karsten Manufacturing Corporation, Phoenix, AZ (US)

( * ) Notice: Subject to any disclaimer, the term of this patent is extended or adjusted under 35 U.S.C. 154(b) by 115 days.

(21) Appl. No.: 14/567,678

(22) Filed: Dec. 11, 2014

(65) Prior Publication Data

US 2016/0166893 A1 Jun. 16, 2016

(51) Int. Cl.
*A63B 53/04* (2015.01)

(52) U.S. Cl.
CPC ..... *A63B 53/0466* (2013.01); *A63B 53/04* (2013.01); *A63B 2053/042* (2013.01); *A63B 2053/045* (2013.01); *A63B 2053/0416* (2013.01); *A63B 2053/0433* (2013.01); *A63B 2053/0458* (2013.01); *A63B 2053/0491* (2013.01); *A63B 2209/00* (2013.01)

(58) Field of Classification Search
CPC ..... A63B 2053/0491; A63B 2053/045; A63B 2053/0416; A63B 2053/0454; A63B 53/04
See application file for complete search history.

(56) References Cited

U.S. PATENT DOCUMENTS 1,575,364 A * 3/1926 Hodgkins ..... A63B 53/02 473/311
2,346,617 A * 4/1944 Schaffer ..... A63B 53/04 273/DIG. 14
3,567,228 A * 3/1971 J. N. ..... A63B 53/04 473/332
4,076,254 A * 2/1978 Nygren ..... A63B 53/04 473/337
5,839,975 A * 11/1998 Lundberg ..... A63B 53/04 473/346
5,863,257 A * 1/1999 Busnardo ..... A63B 53/02 473/246
6,033,319 A * 3/2000 Farrar ..... A63B 53/0487 473/313
6,299,547 B1 * 10/2001 Kosmatka ..... A63B 53/04 473/329

(Continued)

*Primary Examiner* — Melba Bumgarner
*Assistant Examiner* — Amir A Klayman

(57) ABSTRACT

A ball striking device has a head that includes a face member having a striking surface and an inner surface opposite the striking surface, and a body member connected to the face member, where the body member includes a crown portion and a supporting structure. The face member includes a frame portion connected to the supporting structure and forming at least a portion of an outer periphery of the striking surface, where the frame portion includes a mounting structure, and a face plate connected to the mounting structure to form at least a portion of a central region of the striking face. The supporting structure includes a base member forming at least a portion of the sole of the head and a plurality of truss members connected to the base member, such that the truss members connect the base member to the crown portion and the frame portion of the face member.

10 Claims, 7 Drawing Sheets

(56) References Cited

U.S. PATENT DOCUMENTS 6,454,665 B2 * 9/2002 Antonious ..... A63B 53/04 473/346
6,558,271 B1 * 5/2003 Beach ..... A63B 53/04 473/327
6,672,975 B1 * 1/2004 Galloway ..... A63B 53/04 473/342
7,070,514 B1 * 7/2006 Borunda ..... A63B 53/0466 473/234
7,247,104 B2 * 7/2007 Poynor ..... A63B 53/0466 473/329
7,351,161 B2 * 4/2008 Beach ..... A63B 53/0466 473/334
7,367,897 B2 * 5/2008 Poynor ..... A63B 53/0466 473/329
7,798,914 B2 * 9/2010 Noble ..... A63B 53/0466 473/324
8,070,623 B2 * 12/2011 Stites ..... A63B 53/0466 473/329
8,157,668 B2 * 4/2012 Wahl ..... A63B 53/047 473/288
8,192,301 B2 * 6/2012 Park ..... A63B 53/0475 473/332
8,353,784 B2 * 1/2013 Boyd ..... A63B 53/047 473/334
8,419,569 B2 * 4/2013 Bennett ..... A63B 53/0466 473/345
8,475,292 B2 * 7/2013 Rahrig ..... A63B 53/0466 473/324
9,101,811 B1 * 8/2015 Goudarzi ..... A63B 53/0466
2006/0068936 A1 * 3/2006 Dewhurst ..... A63B 53/0466 473/342
2007/0111817 A1 * 5/2007 Chao ..... A63B 53/0466 473/336
2010/0029402 A1 * 2/2010 Noble ..... A63B 53/0466 473/291
2010/0323812 A1 * 12/2010 Boyd ..... A63B 53/0466 473/329
2011/0111885 A1 * 5/2011 Golden ..... A63B 53/0466 473/342
2011/0207552 A1 * 8/2011 Finn ..... A63B 53/0466 473/342
2012/0202615 A1 * 8/2012 Beach ..... A63B 53/06 473/338
2013/0035178 A1 * 2/2013 Roach ..... A63B 53/06 473/345
2013/0090181 A1 * 4/2013 Boyd ..... A63B 53/04 473/288
2014/0187343 A1 * 7/2014 Serrano ..... A63B 53/04 473/288
2014/0187346 A1 * 7/2014 Beno ..... A63B 53/06 473/332
2014/0256463 A1 * 9/2014 Knight ..... A63B 59/0092 473/332
2014/0274446 A1 * 9/2014 Greaney ..... A63B 53/0466 473/307
2014/0274454 A1 * 9/2014 Snyder ..... A63B 53/047 473/332
2015/0306473 A1 * 10/2015 Breier ..... A63B 53/0466 473/336

* cited by examiner

GOLF CLUB HEAD OR OTHER BALL STRIKING DEVICE WITH REMOVABLE FACE AND/OR INTERNAL SUPPORT STRUCTURE

TECHNICAL FIELD

The invention relates generally to ball striking devices, such as golf club heads, and more particularly, to such ball striking devices having a removable face and/or an internally supported structure.

BACKGROUND OF THE INVENTION

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well-known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.). Still other advancements have sought to provide golf club constructions that provide improved feel to the golfer or enhanced energy transfer from the golf club to the golf ball.

While the industry has witnessed dramatic changes and improvements to golf equipment in recent years, there is room in the art for further advances in golf club technology. The present invention seeks to address certain of the shortcomings of prior golf clubs and other ball striking devices, and to provide a design having advantages not previously provided. A full discussion of the features and advantages of the present invention is deferred to the following detailed description, which proceeds with reference to the accompanying drawings.

SUMMARY OF THE INVENTION

The following presents a general summary of aspects of the invention in order to provide a basic understanding of at least some of its aspects. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face member having a striking surface configured for striking a ball and an inner surface opposite the striking surface, and a body member connected to the face member and extending rearwardly from the face member, where the body member includes a crown portion and a supporting structure. The face member includes a frame portion connected to the supporting structure and forming at least a portion of an outer periphery of the striking surface, where the frame portion includes a mounting structure, and a face plate removably connected to the mounting structure to form at least a portion of a central region of the striking face. The frame portion may be connected to the supporting structure by an integral joining technique or other connection. The supporting structure includes a base member forming at least a portion of the sole of the head and a plurality of truss members connected to the base member, such that the truss members connect the base member to the crown portion and the frame portion of the face member.

According to one aspect, the body member further includes one or more body panels supported by the supporting structure and forming portions of a heel, a toe, a rear, and the sole of the head, where the crown portion and the body panel(s) combine to define an enclosed volume of the club head.

According to another aspect, the crown portion is formed by a shell member that extends from the frame portion of the face member rearward to a rearmost point on the club head and covers a top of the club head entirely.

According to another aspect, the face plate is removably connected to the mounting structure by a plurality of fasteners, and the fasteners are accessible from a rear side of the face plate for connection and removal of the fasteners to and from the face plate.

According to a further aspect, at least one opening may be defined between the base member and the crown portion of the body member.

According to yet another aspect, the base portion includes a weight port, and a weight member is received in the weight port. The base portion may further include a plurality of weight ports. At least one weight member may be received in the plurality of weight ports, and the weight member(s) may be interchangeable among the plurality of weight ports. A plurality of weight members may be received in the weight ports, where at least one of the weight members is weighted differently from at least one other weight member, such that interchanging the plurality of weight members among the weight ports is configured to change a weighting configuration of the head.

According to a still further aspect, the frame portion of the face member further includes a wall extending rearward from the striking surface and forming a portion of the sole.

According to an additional aspect, the mounting structure includes a recess in the frame portion of the face member, where the face plate is received within the recess. The face plate may be removably connected to a recessed surface within the recess by a plurality of fasteners in one configuration. The mounting structure may also have a plurality of receivers within the recess in another configuration, and the face plate includes a plurality of pegs, each peg being received in one of the receivers. In this configuration, the fasteners may be connected to the pegs to connect the face plate to the frame portion. The frame portion may further include an opening located within the recess and extending completely through the frame portion, such that the face plate covers the opening.

Additional aspects of the invention relate to ball striking devices, such as golf clubs, with a head that includes a face member having a striking surface configured for striking a ball and an inner surface opposite the striking surface, and a body member connected to the face member and extending rearwardly from the face member. The face member includes a frame portion forming at least a portion of an outer periphery of the striking face, the frame portion having a mounting structure that includes a recess in the frame portion of the face member and a plurality of receivers within the recess. The frame portion has an opening located within the recess and extending completely through the frame portion. The face member also includes a face plate received within the recess and connected to the mounting structure to form at least a portion of a central region of the striking face, such that the face plate covers the opening in the frame portion. The face plate has a plurality of pegs, each peg being received in one of the receivers. A plurality of fasteners are connected to the pegs to connect the face plate to the frame portion.

According to one aspect, the frame portion of the face member also includes a wall extending rearward from the striking surface and forming a portion of the sole.

According to another aspect, the body member includes a crown portion and a supporting structure, where the supporting structure includes a base member forming at least a portion of a sole of the head and a plurality of truss members connected to the base member. The truss members connect the base member to the crown portion and the frame portion of the face member. The body member may further include one or more body panels supported by the supporting structure in one configuration, with the body panels forming portions of a heel, a toe, a rear, and the sole of the head, where the crown portion and the one or more body panels combine to define an enclosed volume of the club head. In another configuration, at least one opening may be defined between the base member and the crown portion of the body member. Additionally, the base portion may include a weight port and a weight member may be received in the weight port.

According to a further aspect, the head may include an adjustable hosel structure connected to the face member, the adjustable hosel structure configured for connection to a shaft.

Further aspects of the invention relate to ball striking devices, such as golf clubs, with a head that includes a face member having a striking surface configured for striking a ball and an inner surface opposite the striking surface, and a body member connected to the face member and extending rearwardly from the face member. The body member includes a crown portion formed as a shell member that extends from a frame portion of the face member rearward to a rearmost point on the club head and covers a top of the club head entirely. The body member also includes a supporting structure that includes a base member forming at least a portion of a sole of the head and a plurality of truss members connected to the base member, where the truss members connect the base member to the crown portion and the face member. The base portion may include a plurality of weight ports, and a plurality of weight members are provided to be interchangeable among the plurality of weight ports. At least one of the weight members is weighted differently from at least one other weight member, such that interchanging the plurality of weight members among the weight ports is configured to change a weighting configuration of the head. The base member may be directly and solely supported by the plurality of truss members in one embodiment.

According to one aspect, the body member further includes one or more body panels supported by the supporting structure and forming portions of a heel, a toe, a rear, and the sole of the head, where the crown portion and the one or more body panels combine to define an enclosed volume of the club head.

According to another aspect, at least one opening is defined between the base member and the crown portion of the body member.

According to a further aspect, the supporting structure also includes a first truss member extending from the base member to the bottom portion of the face member to connect the base member to the bottom portion of the face member, a second truss member extending from the base member to the top portion of the face member to connect the base member to the top portion of the face member, and a third truss member extending rearwardly from the base member to the rear portion of the crown portion to connect the base member to the crown portion. The supporting structure may further include pairs of the first, second, and third truss members. The first pair of truss members may extend forwardly from a front of the base portion, the second pair of truss members may extend upwardly and forwardly from a rear of the base portion, and/or the third pair of truss members may extend upwardly and rearwardly from the rear of the base portion.

According to yet another aspect, the weight ports may be exposed to an exterior of the club head, such that the weight members can be inserted into the weight ports from the exterior of the club head. Additionally, the base portion may include three weight ports aligned in a front-to-rear direction.

Still further aspects of the invention relate to golf clubs or other ball striking devices having a head as described above with a handle or shaft extending therefrom, and/or toward sets of golf clubs including one or more clubs with a head as described above. Clubs such as these may include an adjustable and/or releasable hosel structure.

Other features and advantages of the invention will be apparent from the following specification taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
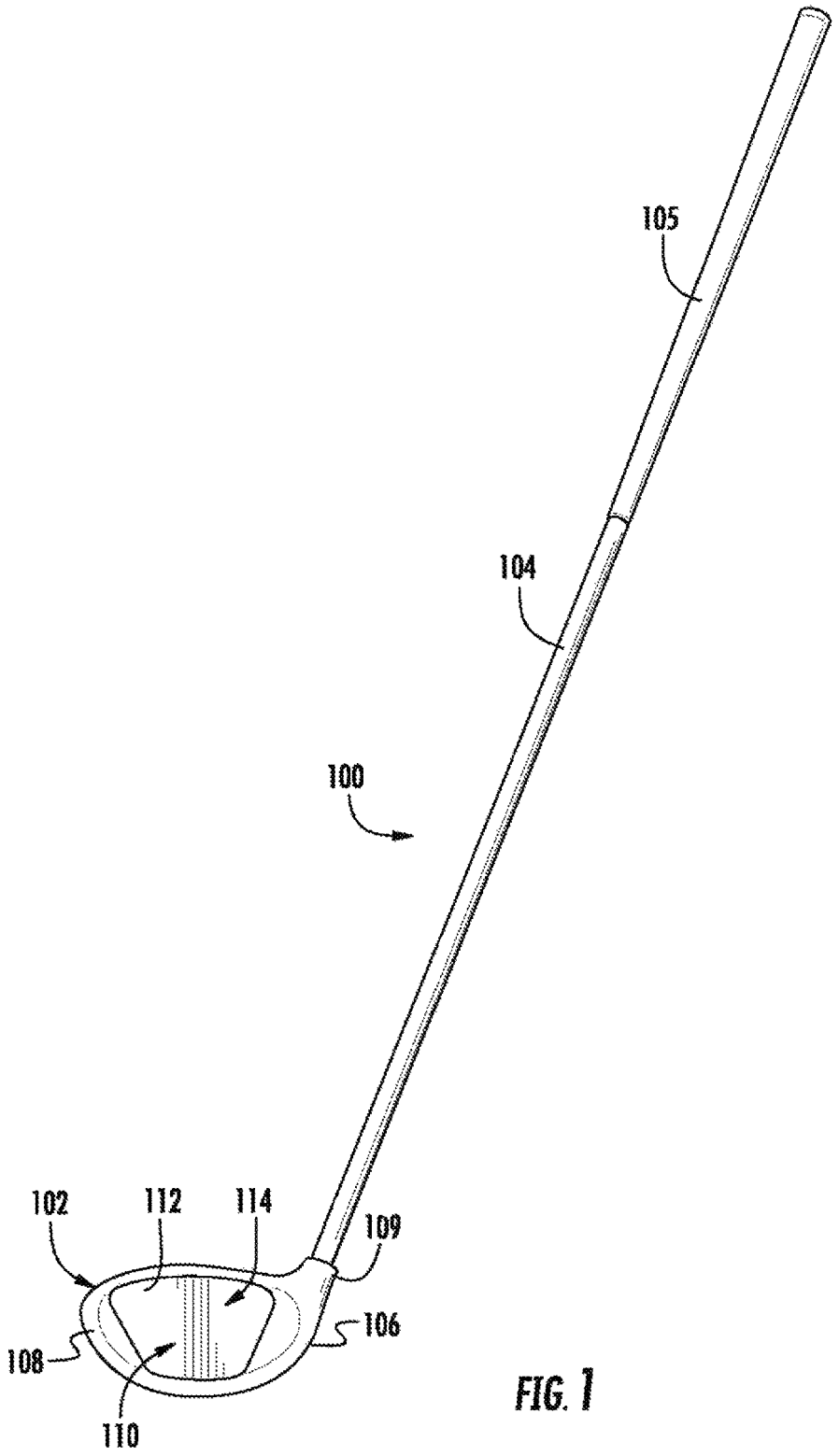
FIG. 1 is a front view of one embodiment of a ball striking device in the form of a driver-type golf club, according to aspects of the present invention.
Figure 2:
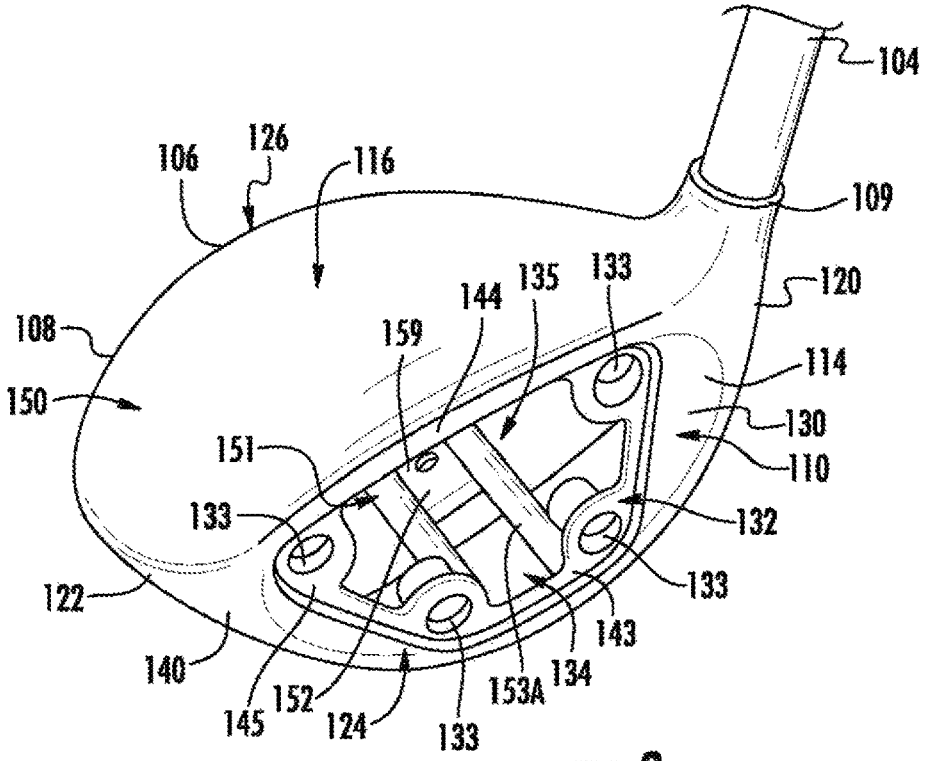
FIG. 2 is a top-front perspective view of a portion of a head of the ball striking device of FIG. 1.
Figure 3:
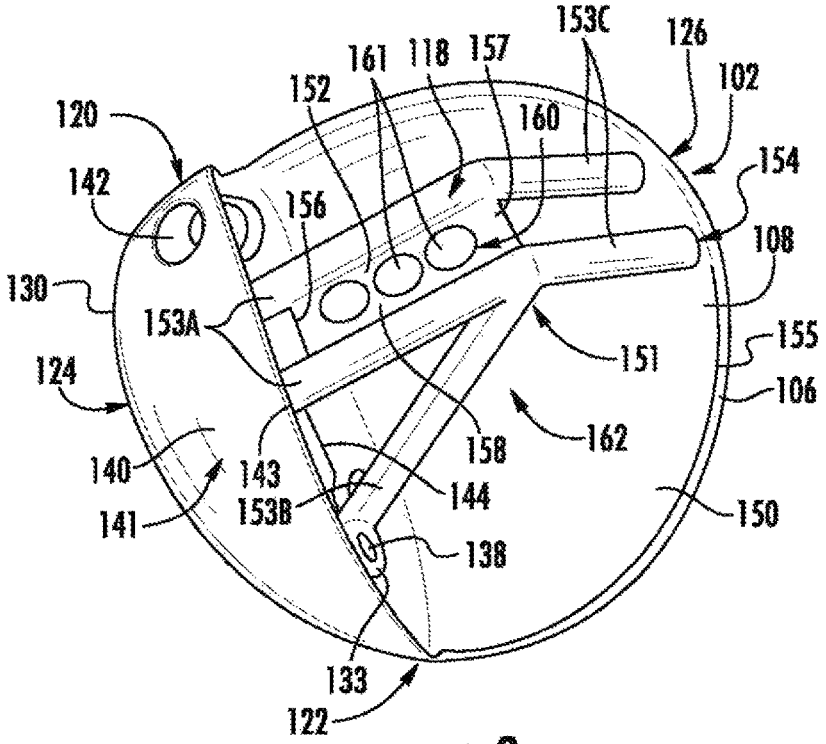
FIG. 3 is a bottom-rear perspective view of the portion of the head of FIG. 2.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three dimensional orientation of structures in order to fall within the scope of this invention.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Metal" and "Metallic" include both pure metals and metal alloys, as well as metal matrix composites, metal foams, composite-reinforced metal structures, and other known metallic materials.

"Integral joining technique" means a technique for joining two pieces so that the two pieces effectively become a single, integral piece, including, but not limited to, irreversible joining techniques such as welding, brazing, soldering, cementing, or the like, where separation of the joined pieces cannot be accomplished without structural damage thereto.

Terms such as "first," "second," "third," "top," "bottom," "front," "rear," etc., as used herein, are intended for illustrative purposes only and do not limit the embodiments. Additionally, the term "plurality," as used herein, indicates any number greater than one, either disjunctively or conjunctively, as necessary, up to an infinite number.

The various figures in this application illustrate examples of ball striking devices according to this invention. When the same reference number appears in more than one drawing, that reference number is used consistently in this specification and the drawings to refer to the same or similar parts throughout.

In general, aspects of this invention relate to ball striking devices, such as golf clubs and golf club heads, including drivers, fairway woods, hybrid clubs, irons, putters, and the like. Such ball striking devices, according to at least some examples of the invention, may include a ball striking head and a ball striking surface. In the case of a golf club, the ball striking surface is a substantially flat surface on one face of the ball striking head. Some more specific aspects of this invention relate to drivers or other wood-type golf clubs and golf club heads, including fairway woods, wood-type hybrid clubs, and the like. It is understood that other aspects of the invention may be utilized in connection with iron-type golf club heads, putter heads, and other types of golf club heads or other ball striking devices.

According to various aspects, the ball striking device may be formed of one or more of a variety of materials, such as metals (including metal alloys), ceramics, polymers, composites, and wood, and may be formed in one of a variety of configurations, without departing from the scope of the invention. According to one aspect, the ball striking device may have a head formed of multiple pieces made from different materials. For example, in one embodiment, the face may be made of a metallic material (including metal alloys), and other components of the head are made of non-metallic or substantially non-metallic materials. Additionally, the components may be formed by various forming methods. For example, metal components may be formed by forging, molding, casting, machining, and/or other known techniques. In another example, composite components, such as carbon fiber-polymer composites, can be manufactured by a variety of composite processing techniques, such as prepreg processing, powder-based techniques, mold infiltration, molding, and/or other known techniques. As a further example, polymer components may be formed by various molding and casting techniques, or other known techniques.

At least some examples of ball striking devices according to this invention relate to golf club head structures, including heads for wood-type golf clubs. Such devices may include a one-piece construction or a multiple-piece construction. An example structure of a ball striking device according to this invention will be described in detail below in conjunction with FIGS. 1-8, and referred to generally using reference numeral "100."

FIG. 1 illustrates an example of a ball striking device 100 in the form of a golf driver, in accordance with at least some examples of this invention. The ball striking device 100 includes a ball striking head 102 and a shaft 104 connected to the ball striking head 102 and extending therefrom. The shaft 104 may include a grip 105. The ball striking head 102 of the ball striking device 100 of FIG. 1 is shown in further detail in FIGS. 2-8. In the example structure shown in FIGS. 1-8, the ball striking head 102 has a hosel 109 extending therefrom. The shape and design of the head 102 may be partially dictated by the intended use of the device 100. In the club 100 shown in FIGS. 1-8, the head 102 has a relatively large size, as the club 100 is designed for use as a driver or wood-type club, intended to hit the ball accurately over long distances. In other applications, such as for a different type of golf club, the head may be designed to have different dimensions and configurations.

Generally, the head 102 includes a face member 112 defining face 114 having a striking surface 110, and a body member 108 extending rearward from the face member 112. In the structure shown in FIGS. 1-8, the head 102 has a multi-piece construction, where the face member 112 includes a frame portion 130 with a separate face plate 131 connected to the frame portion 130. The face member 112 may contain additional pieces in other embodiments. The body member 108 may also be formed as one or more separate pieces. In a further embodiment, the body member 108 may be formed as a single piece with the face member 112, or at least the frame portion 130 thereof. The head 102 may alternately be viewed as including a club head body 106 (e.g., formed of the frame portion 130 of the face member 112 and the body member 108) and a separate face plate 131 connected to the club head body 106.

The face member 112 is located at the front 124 of the head 102, and defines a face 114 having a ball striking surface or striking surface 110 located thereon. The face 114 may also include a rear surface 111 opposite the ball striking surface 110. The ball striking surface 110 is configured to face a ball in use, and is adapted to strike the ball when the device 100 is set in motion, such as by swinging. As shown, the ball striking surface 110 is relatively flat and planar, occupying most of the front of the head 102. The ball striking surface 110 may include some curvature in the top to bottom and/or heel to toe directions (e.g., bulge and roll radii), as is known and is conventional in the art. In other embodiments, the surface 110 may occupy a different proportion of the face 114, or the club head 102 may have multiple ball striking surfaces 110 thereon. In the embodiment shown, the ball striking surface 110 is inclined slightly (i.e., a loft angle), to give the ball slight lift and spin when struck. In other embodiments, the ball striking surface 110 may have a different incline or loft angle, to affect the trajectory of the ball. Additionally, the face 114 may have a variable thickness in some embodiments, i.e., defined between the ball striking surface 110 and the rear surface 111.

In the embodiment of FIGS. 1-8, the face member 112 includes a frame portion 130 with a separate face plate 131 connected to the frame portion 130. The face plate 131 may form at least a portion of the striking surface 110, and may define at least a portion of a center region of the face 114 and the striking surface 110. In the embodiment of FIGS. 1-8, the face plate 131 defines the majority, or the substantial entirety, of the center region of the striking surface 110, including the region of highest response, also known as the "hot zone" or "sweet spot" of the face 114. The frame portion 130 may form at least a portion of an outer periphery of the face 114 and/or the striking surface 110. In the embodiment of FIGS. 1-8, the frame portion 130 forms portions of the striking surface 110 near the heel 120 and toe 122 of the head 102, and defines the entire periphery of the face 114, including the top, bottom, heel and toe edges 113, 115, 117, 119 of the striking surface 110, as shown in FIG. 8A. In this configuration, the face plate 131 extends from the top edge 113 to the bottom edge 115 of the striking surface 110 around the center region of the face 114. The face plate 131 and the frame portion 130 may define different portions of the face 114 and/or the striking surface 110 in other embodiments. For example, in one embodiment, the face plate 131 may define the entire striking surface 110. As another example, the face plate 131 may include rearwardly-extending walls that define portions of the crown 116 and/or sole 118 of the head 102. In further embodiments, the face member 112 may not have a separate face plate 131, or may include multiple face plates 131.

In the embodiment of FIGS. 1-8, the frame portion 130 includes a recess or cavity 134 that receives the face plate 131 therein, such that the outer surfaces of the frame portion 130 and the face plate 131 are flush with each other to form a continuous striking surface 110. Additionally, the frame portion 130 in this embodiment includes an opening 135 within the recess 134 that extends completely through the frame member 112. The frame portion 130 further has a flange 145 that extends around the periphery of the opening 135 to form a recessed surface for the face plate 131 to engage. In other embodiments, the flange 145 may extend around at least a portion of the opening 135 and may be only intermittently present around the opening 135, the flange 145 may have a different form, or the flange 145 may not be present at all. The face plate 131 completely covers the opening 135 in this embodiment. In another embodiment, the frame portion 130 may not include the opening 135, and may include a continuous recessed surface within the recess 134.

Figure 6:
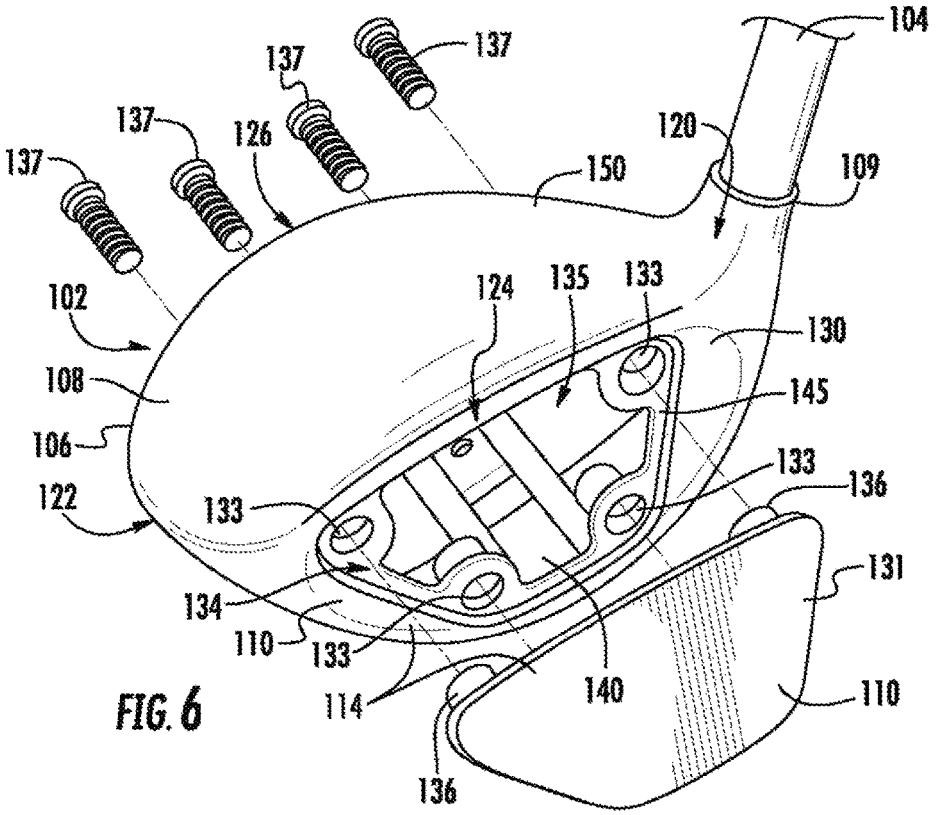
FIG. 6 is a top perspective exploded view of the head of FIG. 4.
Figure 7:
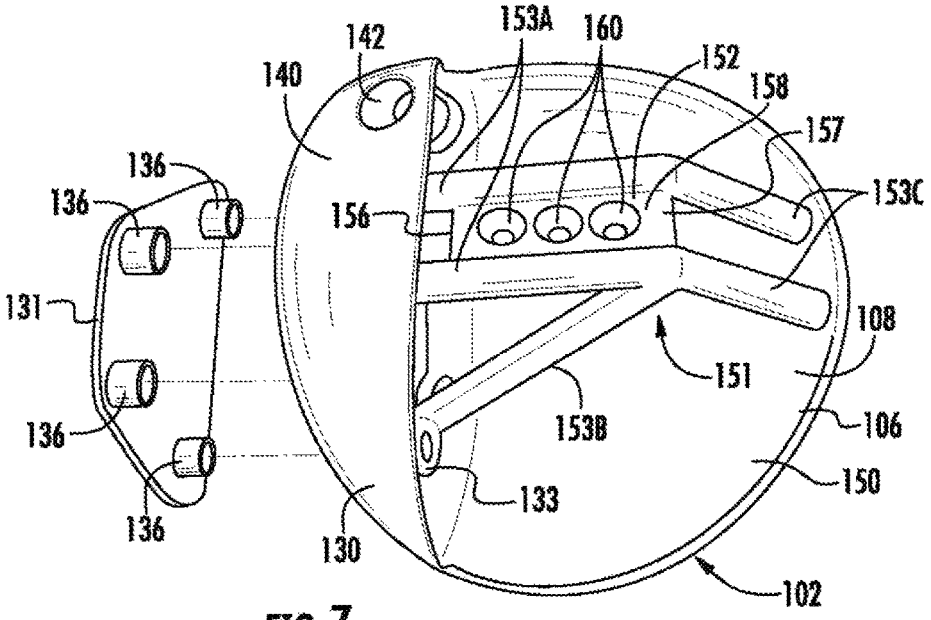
FIG. 7 is a bottom perspective exploded view of the head of FIG. 4.
Figure 8A:
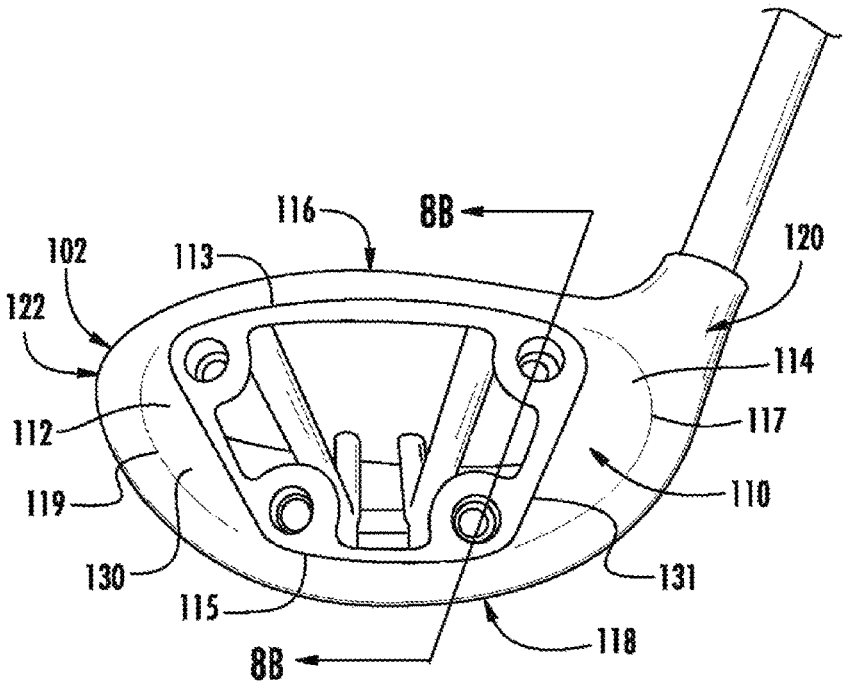
FIG. 8A is a front view of the head of FIG. 4.
Figure 8B:
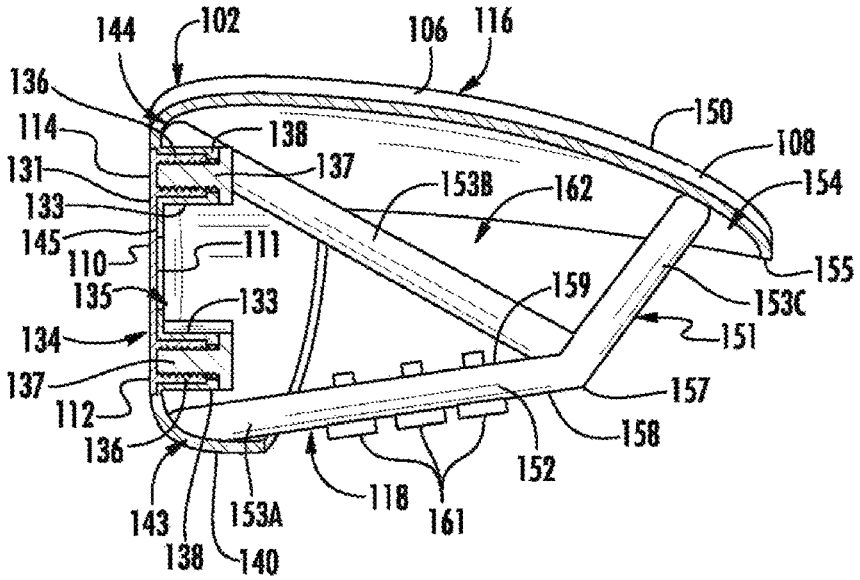
FIG. 8B is a cross-sectional view taken along lines 8B-8B of FIG. 8A.

The face member 114 in the embodiment of FIGS. 1-8 has a mounting structure 132 that connects the face plate 131 to the frame portion 130. The mounting structure 132 is connected to the frame portion 130, and may be considered to be part of the frame portion 130. In one embodiment, the mounting structure 132 may be integrally formed with the frame portion 130 and/or connected to the frame portion 130 by an integral joining technique. The mounting structure 132 may be configured for permanent connection of the face plate 131, or may be configured for removable connection of the face plate 131, in various embodiments. In the embodiment illustrated in FIGS. 1-8, the mounting structure 132 is configured for removable connection to the face plate 131. The mounting structure 132 in this embodiment includes one or more receivers 133 that receive one or more portions of the face plate 131 to connect the face plate 131 to the frame portion 130. For example, as shown in FIGS. 1-8, the face plate 131 has a plurality of pegs or other protrusions 136 that extend rearwardly from the face plate 131 and are received in a plurality of receivers 133. The receivers 133 and the pegs 136 are circular in cross-sectional shape in the embodiment of FIGS. 1-8, but these structures may have a different complementary shape in another embodiment. The receivers 133 in the embodiment of FIGS. 1-8 is connected to the flange 145 that extends around the opening, and may be an integral part of the flange 145. Additionally, the mounting structure 132 in FIGS. 1-8 utilizes fasteners 137 (e.g., screws or bolts) that are connected to the pegs 136 to connect the pegs 136 to the mounting structure 132. As shown in FIG. 8B, the receivers 133 each have a hole 138 at the end, so that the fastener 137 extends through the hole 138 and into the respective peg 136 and also abuts the end of the receiver 133 (around the hole 138) to retain the peg 136 in connection with the receiver 133. The fasteners 137 may be accessible for connection to the face plate 131 and/or removal from the face plate 131 from the rear side of the face plate 131 in one embodiment, and the fasteners 137 in the embodiment of FIG. 6 are illustrated as being inserted into the holes 138 from the rear side of the face plate 131. For example, the fasteners 137 in FIGS. 1-8 are configured to be connected from the rear side of the face 114 by use of a torque wrench, however in other embodiments, the face plate 131 may be configured for insertion of the fasteners 137 from the front side. In other embodiments, the connection between the peg(s) 136 and the receiver(s) 133 may have additional or alternate structure. For example the peg(s) 136 and receiver(s) 133 may include complementary interlocking structures, such as resilient locking tabs or ridges, or other such structure. As another example, the peg(s) 136 and receiver(s) 133 may be connected by a permanent or temporary bonding material, such as an adhesive, or by a permanent or temporary joining technique, such as various welding or brazing techniques. As a further example, the peg(s) 136 and receiver(s) 133 may be connected by a different type of mechanical fastener. A different type of mating connector may be used instead of the receivers 133 in another embodiment, such as a post or other male-type connection that is received in a receiver on the face plate 131.

In one embodiment, the connections of the fasteners 137 to the face plate 131 may influence the response characteristics of the face plate 131. For example, with fasteners 137 in the form of screws or bolts (as in FIGS. 1-8), the relative tightness of the connections of the fasteners 137 may increase or decrease tension in the face plate 131, which may increase or decrease the flexibility of the face plate 131, thereby affecting the response properties (e.g., COR) of the face 114. This effect may be general or localized, depending upon factors such as the relevant structural configurations and orientations of the connected components. In one embodiment, one or more of the fasteners 137 may be connected more tightly or more loosely than one or more other fasteners 137, in order to influence the impact properties of the face plate 131. In another embodiment, one or more of the holes 138 may be left empty (i.e., with no fastener 137), in order to influence the impact properties of the face plate 131. In further embodiments, the configurations of the fasteners 137 may be adjusted as desired, such as by connecting, removing, tightening, and/or loosening, to provide a desired impact response.

The fasteners 137 may also be provided with different weighting characteristics to adjust the weighting characteristics of the club head in one embodiment. In this configuration, at least one of the fasteners 137 may have a different weighting characteristic than at least one other fastener 137, such that connecting these fasteners 137 in different positions may shift the CG of the club head 102 and/or influence the MOI of the club head 102. For example, using heavier fasteners 137 in the holes 138 on the top side of the face 114 and/or lighter fasteners 137 in the holes 138 on the bottom side of the face 114 can raise the CG of the club head. As another example, using heavier fasteners 137 in the holes 138 on the bottom side of the face 114 and/or lighter fasteners 137 in the holes 138 on the top side of the face 114 can lower the CG of the club head. As a further example, the CG may be shifted toward the heel 120 or the toe 122 using similar techniques. Still further weighting options are possible and recognizable by those skilled in the art. It is understood that the fasteners 137 may further be removable and interchangeable to allow for adjustment of the weighting of the club head 102. The weighting configurations of the fasteners 137 may be provided using any of the techniques described herein with respect to the weights 161. For example, different fasteners 137 may be formed of different materials to provide them with different weights and/or densities.

The face member 112 may have a cup-face structure, including one or more walls 140 extending rearwardly from the face 114 in one embodiment, forming portions of the top 116, sole 118, heel 120, and/or toe 122 of the club head 102. Said wall(s) 140 may be considered part of the frame portion 130 in a face member 112 with a multi-piece face 114, such as illustrated in FIGS. 1-8. It is understood that the wall(s) 140 may also be formed of one or more separate pieces, or may be integrally formed with the frame portion 130. In one embodiment, the face member 112 includes a wall 140 having at least a sole portion 141 extending rearward from at least the bottom edge 115 of the face 114 and forming a portion of the sole 118 of the head 102. In the embodiment of FIGS. 1-8, the face member 112 includes such a sole portion 141, as well as forms a peripheral wall member around the entire face 114. In the embodiment of FIGS. 1-8, the wall 140 extends around the entire periphery of the face 114, forming portions of the top 116, sole 118, heel 120, and/or toe 122 of the club head 102. The wall 140 may also form one or more points of connection for connecting the body member 108 to the face member 112, as described below. In various embodiments, the wall 140 may continuously extend around a portion or the entirety of the face 114, or the wall 140 may be intermittently present around certain portions of the periphery of the face 114. In a further embodiment, the face member 112 may have no wall 140, and the body member 108 may join to the face member 112 around the periphery of the face 114. It is understood that at least a portion of the face member 112 (e.g., the frame member 130) may be formed as a single piece with the body member 108, as described above.

The wall 140 may also form a structure for connection to the hosel 109, such as shown in the embodiment of FIGS. 1-8. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties. The wall 140 may include an aperture 142 in the sole portion 141, for use in connecting and/or adjusting such a connecting structure. In other embodiments, at least a portion of the shaft 104 may be an integral piece with the wall 140 or another portion of the head 102, and/or the head 102 may not contain a hosel 109 or may contain an internal hosel structure.

The face member 112 may be made from one or more of various materials. In one embodiment, the entire face member 112 may be made from a titanium alloy or other metallic material, including the entire face 114 (including the face plate 131) and the wall 140. This structure provides good strength, durability, and resilience for the face 114, as well as a strong and stable connecting structure for the hosel 109 and shaft 104. In another embodiment, a portion of the face member 112 may be made from a different material, including other metallic materials, polymers, ceramics, composites, etc. For example, the face plate 131 may be made from a different material from the frame portion 130, such as to provide a different impact behavior (e.g., different impact features, different spin, etc.), greater durability, different weight, or other different features. As another example, at least a portion of the wall 140 may be formed of a different material from the rest of the face member 112, such as to influence weighting of the head 102. Further different material configurations are contemplated.

Figure 4:
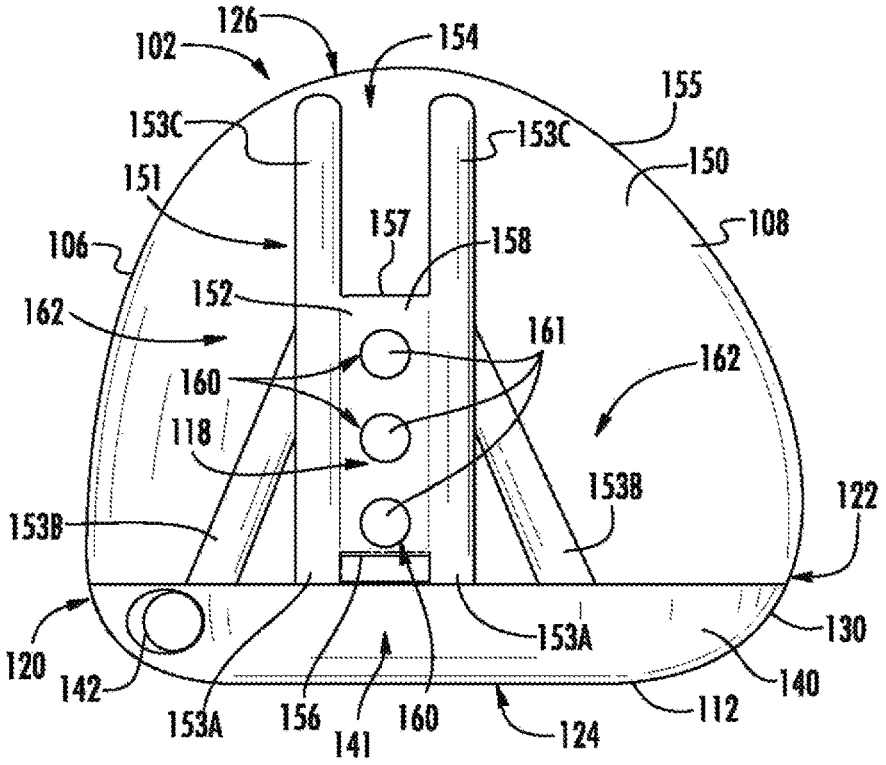
FIG. 4 is a bottom view of the head of the ball striking device of FIG. 1.
Figure 5:
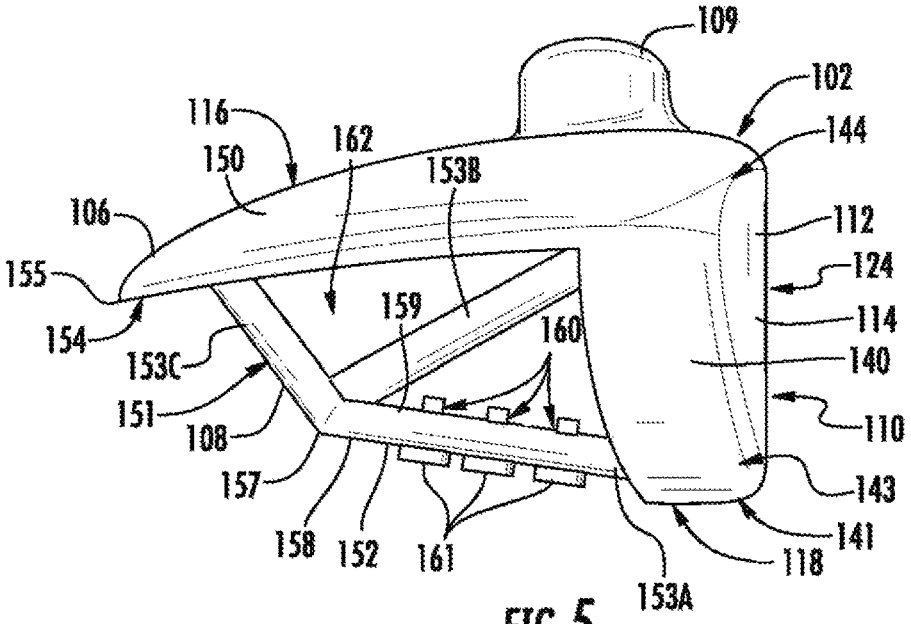
FIG. 5 is a side view of the head of FIG. 4.

The body member 108 is connected to the face member 112 and extends rearwardly from the face member 112, forming at least a portion of the top 116, sole 118, and rear 126 of the head 102. The body member 108 in FIGS. 1-8 includes at least a crown portion 150 and a supporting structure 151. The crown portion 150 illustrated in FIGS. 1-8 forms the majority of the top 116 of the club head 102, and combines with the wall 140 of the face member 112 to define the entire top 116 of the head 102. In another embodiment, the crown portion 150 may form the entire top 116 of the head 102, and may extend and connect to the outer periphery of the face 114. The crown portion 150 in this embodiment is a shell member that is connected to the wall 140 of the face member 112 and is also supported from below by the supporting structure 151. Such a shell member may have a relatively small wall thickness, e.g., smaller than the thickness of any of the truss members 153 of the supporting structure 151 (see below). As seen in FIG. 4, the crown portion 150 in this embodiment defines the entire outer periphery of the body member 108 and the entire rear periphery of the head 102, so that none of the supporting structure 151 is visible when viewing the head 102 from above the top 116, in the normal address position for striking a golf ball. The crown portion 150 also forms a lip 155 extending around the heel 120, toe 122, and rear 126 of the club head 102 in this embodiment, and the entire supporting structure 151 is positioned inwardly from the lip 155. The crown portion 150 may be formed of a variety of different materials, including a metallic material, a composite or polymer material, or other suitable material. In one embodiment, the face member 112 may be formed of a metallic material and the crown portion 150 may be formed of a composite and/or polymer material. In another embodiment, the crown portion 150 may be made from the same material as the face member 112, and may further be integrally formed with the face member 112. The crown portion 150 illustrated in FIGS. 1-8 is a single-piece shell member, however in other embodiments, the crown portion 150 may be a multi-piece shell member, or may have a different configuration. It is understood that the crown portion 150 may be a structural member in one embodiment, or may be a non-structural and/or cosmetic member in another embodiment.

The supporting structure 151 generally includes a truss structure that is connected to the face member 112 and the crown portion 150 and provides structural support for the head 102. In the embodiment of FIGS. 1-8, the supporting structure 151 includes a base member 152 forming at least a portion of the sole 118 of the head 102 and a plurality of truss members 153 connected to the base member 152. As seen in FIGS. 3-5 and 7, the supporting structure 151 includes at least a first truss member 153A and a second truss member 153B extending from the base member 152 to a bottom portion 143 and a top portion 144 of the face member 112, respectively, to connect the base member 152 to the bottom and top portions 143 of the face member 112, and at least a third truss member 153C extending rearwardly from the base member 152 to the crown portion 150 to connect the base member 152 to the crown portion 150. In the embodiment of FIGS. 1-8, the supporting structure 151 includes a pair of first truss members 153A, a pair of second truss members 153B, and a pair of third truss members 153C. As shown in FIGS. 3-5 and 7, the second pair of truss members 153B extend away from each other as they approach the top portion 144 of the face member 112, and the first and third pairs of truss members 153A,C are generally parallel to each other in this embodiment, although this orientation may be different in other embodiments. In additional embodiments, the supporting structure 150 may include a different number of truss members 153, including additional first, second, and/or third truss members 153A-C, and additionally or alternately, other truss members 153 connected to other portions of the head 102. For example, the third truss members 153C illustrated in FIGS. 3-5 and 7 connect to the underside of the crown portion 150 at a rear portion 154 of the crown portion 150, however in other embodiments, the third truss members 153C may additionally or alternately connect to other portions of the crown portion 150. The truss members 153 in the embodiment of FIGS. 1-8 have generally the same circular cross-sectional shape and thickness, however it is understood that this may not be the case in other embodiments.

The base portion 152 generally forms at least a portion of the sole 118 of the head 102. The base portion 152 in the embodiment of FIGS. 1-8 is a relatively rectangular, relatively planar member that is located approximately along a centerline of the head 102 (i.e., a plane passing through the geometric center of the face 114). As illustrated in FIGS. 3-5 and 7, the base portion 152 includes a front end 156 that is spaced a small distance rearward from the face member 112 and a rear end 157 that is spaced a larger distance rearward from the face member 112. The first pair of truss members 153A extend from the front end 156 to the face member 112, and in the embodiment of FIGS. 1-8, the first pair of truss members 153A run along the sides of the base member 152 to the rear end 157 and form part of the base member 152. In other embodiments, the first pair of truss members 153A may terminate at the front end 156 of the base member 152, or the front end 156 of the base member 152 may be directly connected to the face member 112, without the first pair of truss members 153A. The second and third pairs of truss members 153B-C are connected to the rear end 157 of the base member 152 and extend from the rear end 157. The second pair of truss members 153B extend forwardly and upwardly from the rear end 157 of the base member 152, and the third pair of truss members 153C extend rearwardly and upwardly from the rear end 157 of the base member 152. In other embodiments, the second and third pairs of truss members 153B-C may be connected to other points on the base member 152. In other embodiments, the base member 152 may have a different structure, such as a different shape, size, contour, etc.

The supporting structure 151 may be made from a number of different materials, including metallic materials (e.g., aluminum or titanium), composites, polymers, and other materials. In one embodiment, the supporting structure 151 provides primary structural support for the head 102, and is made from a material with sufficient strength to provide such structural support, such as titanium or another metallic material. The base member 152 and the truss members 153 can be formed integrally with each other, or the truss members 153 may be connected to the base member 152, such as by an integral joining technique or another type of connection. A combination of such connections may be used as well. In one embodiment, the base member 152 and the truss members 153 are made from metallic materials that are connected by welding, brazing, etc. These metallic pieces may be connected to other metallic pieces (e.g., a metallic face member 112) in a similar manner and/or may be connected to non-metallic pieces (e.g., a composite crown portion 150) by use of an adhesive or other bonding material, fasteners, or other mechanical connection. The supporting structure 151 may be made from the same material as the face member 112 and/or the crown portion 150, or may be made from a material different from one or both of such structures.

In one example embodiment, the supporting structure 151 is formed of aluminum, the face 114 (including the face plate 131) is made of titanium, and the crown portion 150 is also made of titanium. The supporting structure 151 in this configuration may be connected to the titanium components in this embodiment by use of small screws or other fasteners that are connected and then sanded down to be flush with the adjacent surfaces, or by use of another mechanical joining technique. In another example embodiment, the supporting structure 151, the face 114, and the crown portion 150 are all made of titanium, and may be connected together by welding or other integral joining technique. In a further example embodiment, the supporting structure 151 is made from a metal material, and the crown portion 150 is made from a reinforced polymer or other composite material. The supporting structure 151 in this configuration may be connected to the crown portion 150 by mechanical joining techniques, such as screws, adhesives, etc. Further different configurations and combinations of materials are possible, using any of the connection techniques described herein.

In one embodiment, one or more weight ports 160 that are each configured to receive a weight 161 may be supported by the supporting structure 151. In the embodiment of FIGS. 1-8, the weight ports 160 are located within the base member 152. The weight ports 160 in this configuration are supported by the supporting structure 151, and the base member 152 and the weight ports 160 are directly and solely supported by the truss members 153. Each weight port 160 may be configured so that the weight 161 may be removably received in the weight port 160, such as by threaded connection, releasable resilient tabs, or other types of removable connections. The weight ports 160 may be accessible to receive the weights 161 from the bottom surface 158 of the base member 152 in one embodiment, and may be accessible from the top surface 159 in another embodiment. In the embodiment of FIGS. 1-8, the base member 152 has three weight ports 160 that are linearly aligned along the base member 152, and are each accessible from the bottom surface 158 of the base member 152 to receive a weight 161 in a removable connection. Additionally, the weight ports 160 in this embodiment are similarly configured, so that the weights 161 may be interchangeable between the different weight ports 160. In this configuration, the weighting of the head 102 can be changed by shifting and interchanging weights between the different weight ports 160, such as by using a combination of light weights (e.g., aluminum, etc.), medium weights (e.g., steels), and/or heavy weights (e.g., tungsten). Shifting the weights 161 among the weight ports 160 in the embodiment of FIGS. 1-8 permits the weighting of the club head 102 to be shifted along the front-to-rear axis. In another embodiment, the base member 152 may have the weight ports 160 arranged in a different configuration, including side-by-side configurations or other configurations that may further enable weight shifting from side-to-side, top-to-bottom, etc. In further embodiments, other portions of the face member 112 and/or the body member 108 may be configured to receive removable weights. It is understood that the number of weight members 161 may be different from the number of weight ports 160 in some embodiment, such that not all the weight ports 160 may receive weight members 161 and/or that different weight members 161 can be selected from a larger set, to provide a greater number of different weighting configurations. In other words, the user may elect to leave one or more weight ports 160 empty, and may further elect to use any similarly-configured weight 161 in any weight port 162, and to interchange the weights 161 between the weight ports 160, in one embodiment.

Figure 9:
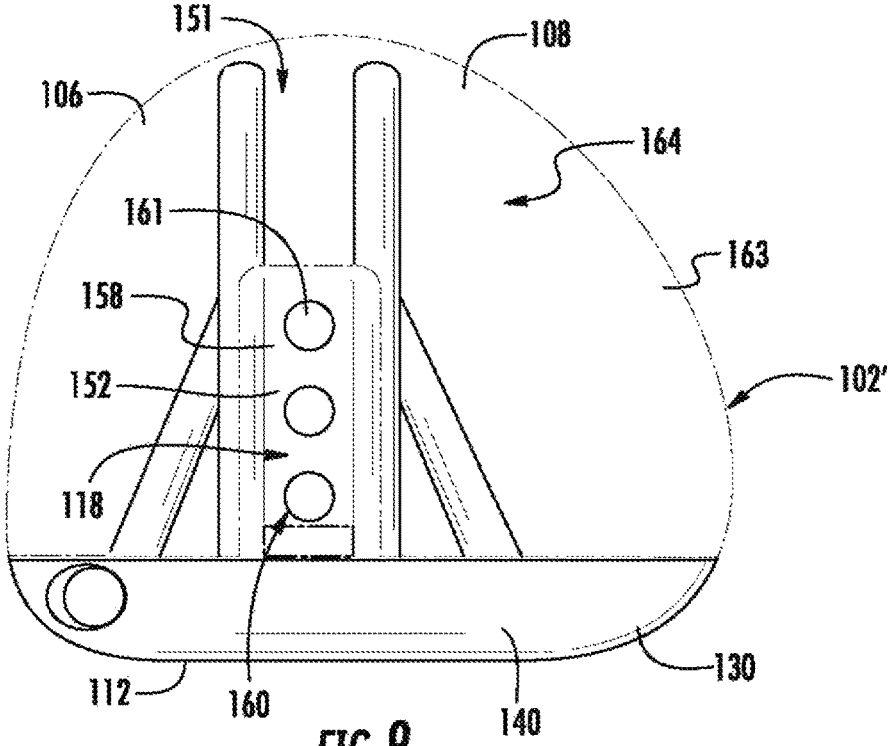
FIG. 9 is a bottom view of another embodiment of a head of a ball striking device in the form of a driver-type golf club head, according to aspects of the present invention, showing a portion of a body of the head in transparency.
Figure 10:
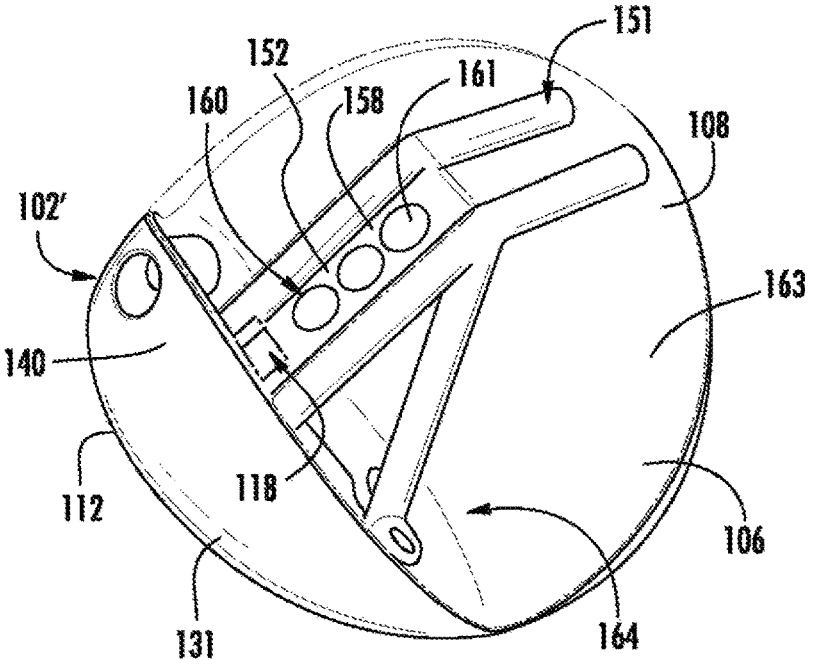
FIG. 10 is a bottom-rear perspective view of the head of FIG. 9, showing a portion of a body of the head in transparency.
Figure 11:
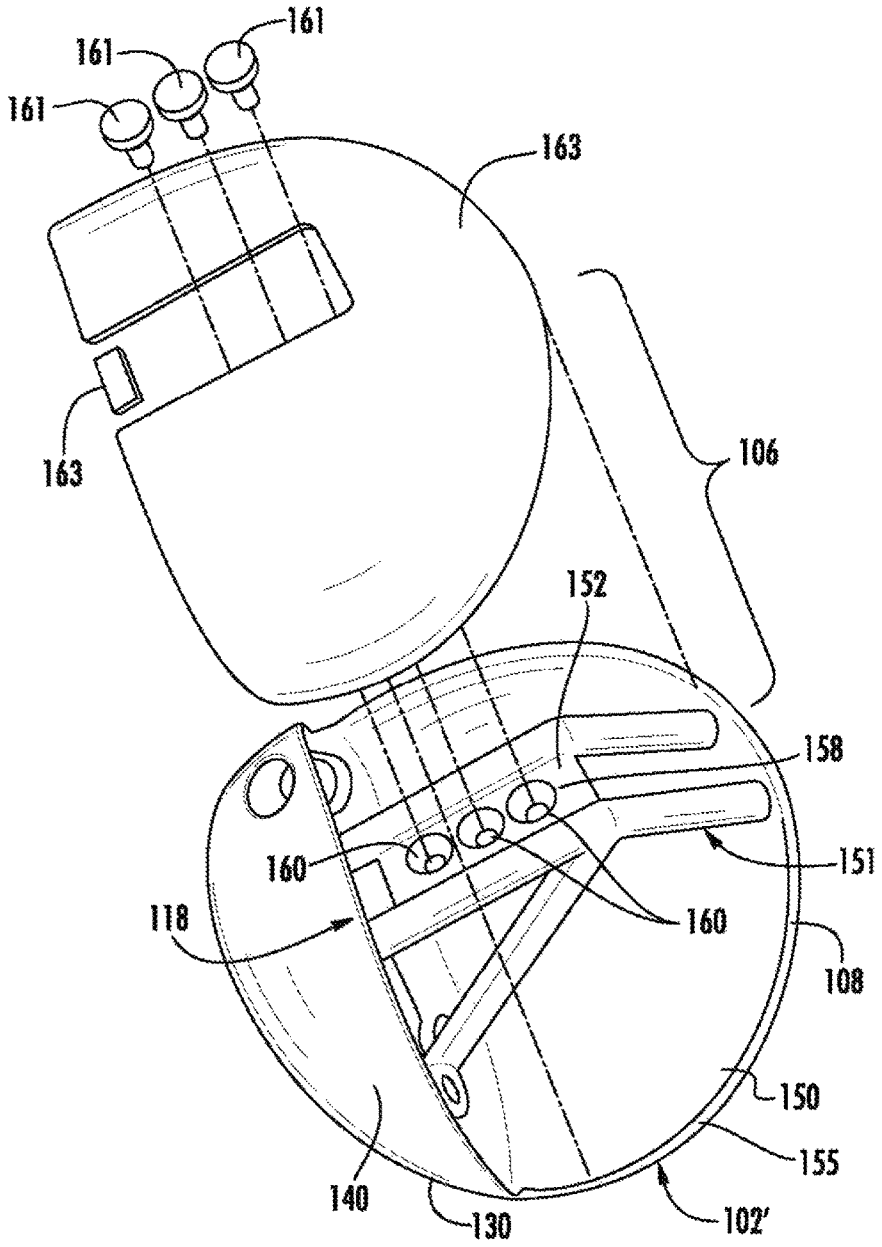
FIG. 11 is a partially exploded bottom-rear perspective view of the head of FIG. 9.

The golf club head 102 shown in FIGS. 1-8 has an open interior, such that openings 162 are defined between the components of the support structure 151, the crown portion 150, and the face member 112. Consequently, in the embodiment of FIGS. 1-8, the rear surface 111 of the face 114 and the underside of the crown portion 150 are exposed to the exterior of the head 102. The openings 162 may provide access to the receivers 133 and the fasteners 137 to permit connection and/or disconnection of the fasteners 137 for removal and connection of the face plate 131. Likewise, in embodiments where the face plate 131 uses a different connecting structure, the openings 162 may provide access to such connecting structure. The openings 162 may also provide access for inserting the weights 161 into the weight ports 160 from the top surface 159 of the base member 152, in one embodiment. In other embodiments, the head 102 may include a different number and/or configuration of openings 162, depending on the configurations of the face member 112 and the body member 108. In further embodiments, one or more of the openings 162, or possibly all of the openings 162, may be covered by body panels or other structures. FIGS. 9-11 illustrate one such embodiment.

FIGS. 9-11 illustrate another embodiment of a golf club head 102' that is similar or identical to the head 102, and further includes one or more body panels 163 covering the openings 162 in the club head, thereby defining an enclosed internal cavity 164. The internal cavity 164 may be defined by other components as well, including the rear surface 111 of the face 114, inner surfaces of the wall 140, the underside of the crown portion 150, the top surface 159 of the base portion 152, and others. In this embodiment, the bottom surface 158 of the base portion 152 is exposed and forms a portion of the sole 118 of the head 102'. This configuration also permits the weight ports 162 to be accessible for insertion of the weights 161 from the bottom surface 158. The body panels 163 may be connected to or otherwise engage various components of the head 102', for example, the wall 140 and/or other components of the face member 112, the crown portion 150 of the body member 108, and the base member 152 and/or the truss members 153 of the supporting structure 151. The components of the face member 112 and the body member 108 may have structures to engage and/or retain the body panels 163, such as ledges, flanges, lips, supports, etc. In other embodiments, the head 102' may include a different number or configuration of body panels 163. For example, the body panels 163 illustrated in FIGS. 9-11 may all be configured as a single body panel 163, or may be multiple, separate body panels 163. As another example, one or more of the openings 162 may not be covered by the body panels 163. As a further example, one or more of the body panels 163 may be removable and reconnectable, to permit access to the internal cavity 164, e.g., for accessing the receivers 133 or the weights 161, and/or interchanging of the body panels 163. Further configurations are contemplated. For example, in one embodiment, the head 102' may have one or more body panels 163 that are made from a flexible material, such as a fabric or other woven material. Such body panels 163 may be non-structural or partially non-structural in nature. Additionally, the body panel(s) 163 (flexible and/or rigid) may completely cover the sides and bottom of the head 102', and may be configured to provide access to the cavity, e.g., for manipulation of the weights 161 and/or the fasteners 137. For example, the body panel(s) 163 may be removable, as described above. As another example, the body panel(s) 163 may have a door or window (or multiple such structures) that can be opened to provide such access. As a further example, a flexible body panel 163 may have a flap or opening that can be opened and closed by connections such as a zipper, snaps, buttons, etc.

The body panels 163 may be formed from any materials described herein, including polymers, composites, metallic materials, etc., or combinations of such materials. Each body panel 163 may be made from a single piece or multiple pieces, and different body panels 163 may be configured and/or formed differently. In one embodiment, the body panels 163 may all be formed from graphite-epoxy composites or other composites, such as by use of prepreg processing techniques. The head 102' illustrated in FIGS. 9-11 is configured as a driver-type head, however similar configurations may be used with other types of wood golf club heads, such as fairway woods, hybrid clubs, etc. When configured as a driver, the club head 102' may have a volume of at least 400 cc, and in some structures, at least 450 cc, or even at least 460 cc. Other appropriate sizes for other club heads may be readily determined by those skilled in the art.

In one embodiment, the face member and the supporting structure 151 (or the entire body member 108) may constitute the entire structural support of the head 102', and all of the body panels 163 may be non-structural and/or cosmetic members. In this configuration, the head 102' may be considered to include a structural frame 101 that includes the features of the head 102 of FIGS. 1-8 described herein, and one or more non-structural body panels 163 connected to the structural frame 101. In other embodiments, some or all of the body panels 163 may provide structural support for the head 102. In further embodiments, one or more of the body panels 163 may be configured to provide functional characteristics for the head 102', such as providing desired weighting configurations, influencing aerodynamics and/or ground engagement behavior, influencing response force on the face, damping of sound and/or vibrations, etc.

It is understood that any of the components and features described above with respect to the golf club heads 102, 102' illustrated in FIGS. 1-10, as well as any other embodiments described herein, may be used individually or in any suitable combination. Additionally, the components and features of the various embodiments described and illustrated herein may be utilized in other types of golf club heads or other ball striking devices, in various combinations.

The ball striking devices and heads therefor as described herein provide many benefits and advantages over existing products. For example, the heads 102, 102' described herein may be configured to provide a face plate 131 that has high flexibility and high response (e.g., high COR and energy transfer). Such flexibility can decrease the durability of the face plate 131, and the structure of the receivers 133 permits the face plate 131 to be removed and replaced if it is deformed, cracked, or otherwise damaged. The face plate 131 can further be interchanged with another face plate 131 having different flexibility and/or response properties. Additionally, if an open structure is utilized, the openings 162 provide access for replacing the face plate 131. As another example, the face plate 131 may be removed and replaced for other reasons as well, such as to provide different performance characteristics (response, spin, etc.), different weighting, different cosmetic appearance, etc. As further example, the heads 102, 102' have minimal structural components, which decreases the total necessary weight of the head 102, 102', allowing discretionary weight to be positioned where desired. The weights 161 in the base member 152 can provide a wide variety of adjustable weighting configurations. Still other benefits and advantages are recognizable to those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a face member having a striking surface configured for striking a ball and an inner surface opposite the striking surface;

a face plate removably connected to a mounting structure of the face member, wherein the face plate is interchangeable with different face plates having different response properties to prove different performance characteristics;

a body member connected to the face member and extending rearwardly from the face member, wherein the body member comprises:

a cavity;

a crown portion formed as a shell member that extends from a frame portion of the face member rearward to a rearmost point on the club head and covers a top of the club head entirely; and an internal supporting structure positioned within the cavity, comprising a base member forming at least a portion of a sole of the head and a plurality of truss members connected to the base member, wherein the base member is a substantially rectangular planar member and comprises a plurality of weight ports; and wherein a front end of the base member is separated from the face member by a void defining a first distance, a plurality of weight members that are interchangeable among the plurality of weight ports, wherein at least one of the weight members is weighted differently from at least one other weight member, such that interchanging the plurality of weight members among the weight ports is configured to change a weighting configuration of the head;

wherein the internal supporting structure is not visible when viewing the golf club head from above; and wherein the internal supporting structure further comprises:

a first pair of truss members extending from the base member to a bottom portion of the face member to connect the base member to the bottom portion of the face member;

a second pair of truss members extending from the base member to a top portion of the face member to connect the base member to the top portion of the face member; and a third pair of truss members extending rearwardly from the base member to a rear portion of the crown portion to connect the base member to the crown portion.

2. The golf club head of claim 1, wherein the body member further includes one or more body panels supported by the internal supporting structure and forming portions of a heel, a toe, a rear, and the sole of the head, wherein the crown portion and the one or more body panels combine to define an enclosed volume of the club head.

3. The golf club head of claim 1, wherein at least one opening is defined between the base member and the crown portion of the body member.

4. The golf club head of claim 1, wherein the first pair of truss members extends forwardly from a front of the base member, the second pair of truss members extends upwardly and forwardly from a rear of the base member, and the third pair of truss members extends upwardly and rearwardly from the rear of the base member.

5. The golf club head of claim 1, wherein the weight ports are exposed to an exterior of the club head, such that the weight members can be inserted into the weight ports from the exterior of the club head.

6. The golf club head of claim 1, wherein the base member includes three weight ports aligned in a front-to-rear direction.

7. The golf club head of claim 1, wherein the face plate is removably connected to the mounting structure by a plurality of fasteners, and wherein the fasteners are accessible from a rear side of the face plate for connection and removal of the fasteners to and from the face plate.

8. The golf club head of claim 1, wherein the frame portion of the face member further comprises a wall extending rearward from the striking surface and forming a portion of the sole.

9. The golf club head of claim 1, wherein the mounting structure comprises a recess in the frame portion of the face member, wherein the face plate is received within the recess.

10. The golf club head of claim 9, wherein the frame portion has an opening located within the recess and extending completely through the frame portion, wherein the face plate covers the opening.

* * * * *